US009584914B2

(12) United States Patent
Aubreville et al.

(10) Patent No.: US 9,584,914 B2
(45) Date of Patent: Feb. 28, 2017

(54) METHOD FOR AUTOMATIC ACTIVATION AND DEACTIVATION OF A BINAURAL HEARING SYSTEM AND BINAURAL HEARING SYSTEM

(71) Applicant: SIVANTOS PTE. LTD., Singapore (SG)

(72) Inventors: Marc Aubreville, Nuremberg (DE); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 542 days.

(21) Appl. No.: 13/671,933

(22) Filed: Nov. 8, 2012

(65) Prior Publication Data

US 2013/0114818 A1 May 9, 2013

(30) Foreign Application Priority Data

Nov. 8, 2011 (DE) ..... 10 2011 085 936

(51) Int. Cl.
*H04R 5/00* (2006.01)
*H04R 25/00* (2006.01)

(52) U.S. Cl.
CPC ..... *H04R 5/00* (2013.01); *H04R 25/552* (2013.01); *H04R 25/407* (2013.01); *H04R 2225/61* (2013.01); *H04R 2460/03* (2013.01)

(58) Field of Classification Search
USPC ..... 381/23.1; 607/60
See application file for complete search history.

(56) References Cited

U.S. PATENT DOCUMENTS 6,549,633 B1 * 4/2003 Westermann ..... H04R 25/453 381/312
2010/0208921 A1 8/2010 Fischer
2011/0243339 A1 * 10/2011 Ang ..... H04R 25/50 381/23.1
2012/0128164 A1 * 5/2012 Blamey ..... H04R 5/04 381/28

FOREIGN PATENT DOCUMENTS

EP 2182742 A1 5/2010
EP 2219389 A1 8/2010
WO 2009/153718 A1 12/2009
WO 2010022456 A1 3/2010
WO WO 2010/022456 A1 * 3/2010
WO WO 2010/022456 A1 * 4/2010

* cited by examiner

*Primary Examiner* — Duc Nguyen
*Assistant Examiner* — Yogeshkumar Patel
(74) *Attorney, Agent, or Firm* — Laurence A. Greenberg; Werner H. Stemer; Ralph E. Locher

(57) ABSTRACT

A method of operation saves energy during the operation of a binaural hearing system having a left-hand hearing device and a right-hand hearing device. The method includes providing a left-hand internal input signal in the left-hand hearing device and a right-hand internal input signal in the right-hand hearing device. A sending mode of the left-hand hearing device and/or right-hand hearing device is activated and/or deactivated. The sending mode is therein activated in one of the hearing devices automatically in dependence on the respective internal input signal and the sending mode is deactivated in one of the hearing devices automatically in dependence on the respective internal input signal and of a communication signal received from the respective other hearing device.

7 Claims, 2 Drawing Sheets

METHOD FOR AUTOMATIC ACTIVATION AND DEACTIVATION OF A BINAURAL HEARING SYSTEM AND BINAURAL HEARING SYSTEM

CROSS-REFERENCE TO RELATED APPLICATION

This application claims the priority, under 35 U.S.C. §119, of German application DE 10 2011 085 936.5, filed Nov. 8, 2011; the prior application is herewith incorporated by reference in its entirety.

BACKGROUND OF THE INVENTION

Field of the Invention

The present invention relates to a method for operating a binaural hearing system having a left-hand hearing device and a right-hand hearing device by providing a left-hand internal input signal in the left-hand hearing device, providing a right-hand internal input signal in the right-hand hearing device, activating a sending mode of the left-hand hearing device and/or right-hand hearing device, and deactivating the sending mode. The present invention relates further to a corresponding binaural hearing system having two hearing devices. What is herein understood by a hearing device is any device that can be worn in or on the ear and creates an auditory stimulus, in particular a hearing aid, headset, or headphone, and suchlike.

Hearing aids are wearable hearing devices that serve the needs of people who are hard of hearing. Hearing aids of various designs such as behind-the-ear (BTE) hearing aids, hearing aids having an external earphone (RIC: receiver-in-canal), and in-the-ear (ITE) hearing aids including, for example, "concha" hearing aids or completely-in-canal (CIC) hearing aids are provided to accommodate the numerous individual requirements. The hearing aids listed by way of example are worn on the external ear or in the auditory canal. Also available on the market are bone-conduction hearing aids and implantable or vibrotactile hearing aids. The impaired hearing is therein stimulated either mechanically or electrically.

Hearing aids principally have as their main components an input transducer, an amplifier, and an output transducer. The input transducer is as a rule a sound receiver, for example a microphone, and/or an electromagnetic receiver, for example an induction coil. The output transducer is usually realized as an electroacoustic transducer, for example a miniature loudspeaker, or as an electromechanical transducer, for example a bone-conduction earphone. The amplifier is customarily integrated in a signal-processing unit. That basic structure is shown in FIG. 1 using a behind-the-ear hearing aid as an example. One or more microphones 2 for receiving ambient sound are built into a hearing-aid housing 1 for wearing behind the ear. A signal-processing unit 3, likewise integrated in hearing-aid housing 1, processes the microphone signals and amplifies them. The output signal from signal-processing unit 3 is transmitted to a loudspeaker or, as the case may be, earphone 4, which feeds out an acoustic signal. The sound is possibly conveyed to the hearing-aid wearer's eardrum via an acoustic tube that is fixed into position in the auditory canal by an ear mold. The hearing aid and in particular signal-processing unit 3 is powered by a battery 5 likewise integrated in hearing-aid housing 1.

Highly developed, binaural signal-processing algorithms in hearing aids such as, for example, binaural beam shaping or binaural, spatial noise suppression, require a continuous data link to the respective other hearing aid in the binaural hearing system. However, the problem with a continuously operating data link is that the audio-signal transmission then taking place requires a lot of energy, which in turn reduces a service life of the battery.

Binaural signal transmission is usually activated manually in the case of currently known binaural hearing systems. That is done by, for example, manually selecting a suitable hearing program in a specific situation.

SUMMARY OF THE INVENTION

It is accordingly an object of the invention to provide a method for automatic activation and deactivation of a binaural hearing system and a binaural hearing system which overcome the above-mentioned disadvantages of the prior art methods and devices of this general type, which reduces energy requirements of a binaural hearing system.

The object is inventively achieved by a method for operating a binaural hearing system having a left-hand hearing device and a right-hand hearing device by providing a left-hand internal input signal in the left-hand hearing device and a right-hand internal input signal in the right-hand hearing device. Activation and deactivation of a sending mode of the left-hand hearing device and/or right-hand hearing device is critical. The sending mode is activated in one of the hearing devices automatically in dependence on the respective internal input signal. The sending mode is deactivated in one of the hearing devices automatically in dependence on the respective internal input signal and of a communication signal received from the respective other hearing device.

Further inventively provided is a binaural hearing system having a left-hand hearing device and a right-hand hearing device, with a left-hand internal input signal being provided in the left-hand hearing device, a right-hand internal input signal being provided in the right-hand hearing device, it being possible to activate a sending mode of the left-hand hearing device and/or right-hand hearing device, and it being possible to deactivate the sending mode. It is possible to activate the sending mode in one of the hearing devices automatically in dependence on the respective internal input signal. It is possible to deactivate the sending mode in one of the hearing devices automatically in dependence on the respective internal input signal and of a communication signal received from the respective other hearing device.

Thus the sending mode of one of the hearing devices belonging to the binaural hearing system will advantageously be activated automatically as and when required by the prevailing hearing situation. The internal input signal is for that purpose analyzed by the respective hearing device. Activating of the sending mode can thus be controlled very much in keeping with the requirements. The sending mode will furthermore be deactivated automatically if permitted by the prevailing hearing situation. For that purpose not only the internal input signal is evaluated by the hearing device but also a communication signal received from the other hearing device. For deactivating the sending mode it is hence possible for binaural data to be evaluated in each hearing device. Finally, energy can be saved through automatically activating and deactivating the communication between the two hearing devices because communication will be maintained only for as long as required in the prevailing hearing situation.

A decision reached by one of the hearing devices as regards activating is preferably made known to the respective other hearing device so that the other hearing device will activate the sending mode in dependence on the decision received. What can be achieved thereby is that the two hearing devices will assume the sending mode as simultaneously as possible. If, though, for a specific processing instance it suffices for just one of the hearing devices to have the binaural data available, it will not be necessary to convey the activating decision.

The decision received for activating the other hearing device favorably has a higher priority than the hearing device's internal input signal. So if an activating decision has been received as well as a result of the internal input signal's analysis, then the hearing device's sending mode will be activated and specifically independently of the result of the internal input signal's analysis. Binaural processing thus takes precedence.

In a development of the inventive method, for activating the sending mode the respective internal input signal is analyzed by the respective hearing device in terms of a background noise and the sending mode will be activated if the level of the background noise continuously exceeds a specified threshold. It is thereby made possible, for example, for a binaural directional microphone to be activated if the background noise is a certain level.

According to another development, components of a binaural directional-microphone signal within an angle range of in each case around +45° and −45° referred to a specified frontal direction are used for deactivating the sending mode signal but not signal components around the specified frontal direction. If, for example, noise signals are received from the frontal lateral regions (approximately +45° and −45°), then it will be favorable not to deactivate the sending mode and to activate the binaural directional microphone accordingly. The figures of +45° and −45° are therein not mandatory: Rather it is the case that angles of, for instance, +30° and −30° or +60° and −60° can also be used for that function. All that matters is for the signal components from the frontal direction to have been substantially attenuated relative to signals from adjacent directions for the deactivating decision. Thus what is termed a "binaural eight" signal will be evaluated for the deactivating decision.

For activating the sending mode in one of the hearing devices it is furthermore possible to calculate with what probability a speech sound, referred to a specified frontal direction, is coming from a side or from the front or behind, with the sending mode being activated if the probability of its coming from a side is greater than the probability of its coming from the front or behind. It is thereby possible for what is termed "sideways glancing" of the hearing system to be activated if speech coming from a side is detected. Such situations often arise in vehicles, for instance, when a person is unable to look directly at someone who is speaking.

It is moreover advantageous for the sending mode not to be activated or, as the case may be, to be deactivated if both hearing devices' input signals are below a specified level. That means that very weak input signals indicate a quiet ambient situation so it will be possible to do without directional microphones. It is more advantageous in a quiet situation to select the omnidirectional mode, as a result of which it will be possible to dispense with binaural signal transmission so that in the final analysis a further saving in energy can be achieved.

In parallel with activating the sending mode it is possible also to activate binaural processing, namely a binaural directional microphone, binaural wind-noise suppression, and/or binaural feedback suppression. That means the appropriate binaural algorithms will be activated at the same time as the binaural data is provided.

The sending mode can, however, be deactivated if the effectiveness of binaural processing is below a specified level. If the effectiveness of binaural processing, measurable by comparing the input signal and output signal, is insufficient, then binaural processing can beneficially be dispensed with along with binaural signal transmission, which in the end will again be accompanied by advantages in terms of energy.

Other features which are considered as characteristic for the invention are set forth in the appended claims.

Although the invention is illustrated and described herein as embodied in a automatic activation and deactivation of a binaural hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below are preferred embodiment variants of the present invention.

Figure 1:
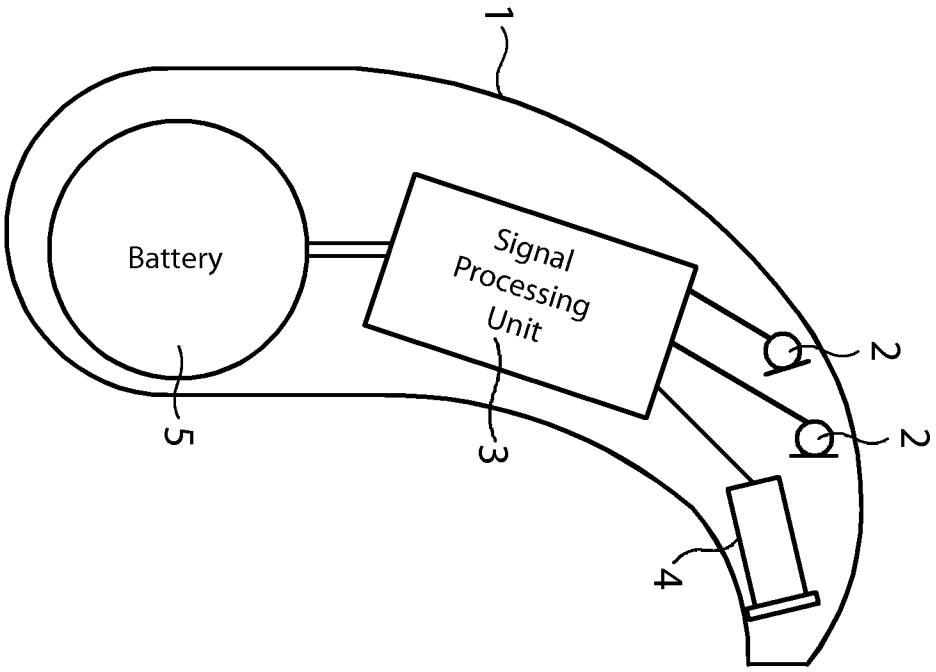
FIG. 1 is an illustration of the basic structure of a hearing aid according to the prior art.
Figure 2:
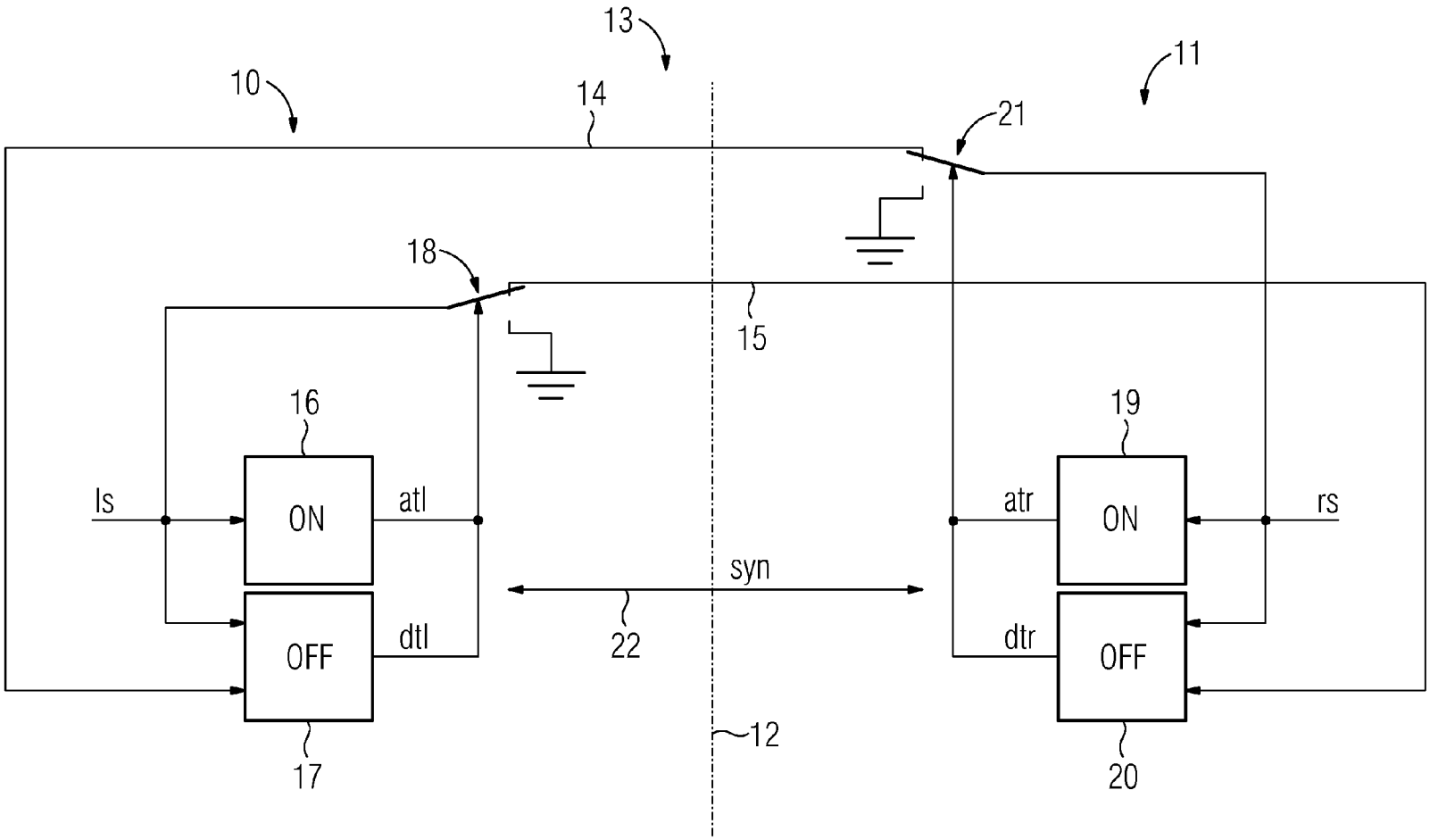
FIG. 2 is a block diagram of a binaural hearing system featuring automatic activating and deactivating of binaural communication according to the invention.

A hearing system has, for example, two hearing aids: A left-hand hearing aid (left-hand hearing device) and a right-hand hearing aid (right-hand hearing device). The left-hand hearing aid is worn on the left ear and the right-hand hearing aid is worn on the right ear. Binaural provisioning can be ensured thereby. FIG. 2 is a schematic of a binaural hearing system of such kind. The hearing system contains a left-hand hearing aid 10 and a right-hand hearing aid 11. The two hearing aids 10, 11 are mutually separated by a system boundary 12. A wireless audio-data link 13 is provided via the system boundary 12. It can also be a cabled link. The data or, as the case may be, communication link 13 is symbolized in FIG. 2 by specific lines 14, 15.

Only lines and decision blocks have been entered in FIG. 2 as representative of individual hearing aids 10, 11. In the interest of clarity, a hearing aid's other customary components are not shown in FIG. 2.

The left-hand hearing aid 10 has a decision-making unit 16 by which a decision is made about activating a sending mode of left-hand hearing aid 10. The left-hand hearing aid 10 furthermore has a decision-making unit 17 that makes a decision about deactivating a sending or, as the case may be, transmitting mode of left-hand hearing aid 10.

The input signal of decision-making unit 16 for activating the sending mode is a left-hand signal Is constituting an internal input signal of the left-hand hearing device or, as the case may be, of left-hand hearing aid 10. The left-hand signal Is is, for example, a microphone signal from a microphone belonging to left-hand hearing aid 10. The decision-making unit 16 analyzes internal input signal Is and feeds out an appropriate output signal atl for activating the sending mode or, as the case may be, transmission. With the output signal atl it is possible to symbolically actuate a switch 18 by which sending or, as the case may be, transmitting can be activated and deactivated. The sending mode has been activated (switch 18 is switched on) in the example shown in FIG. 2 so that internal input signal Is of left-hand hearing aid 10 can be transmitted as the communication signal wirelessly or on a wired basis to right-hand hearing aid 11 over (virtual) line 15.

The right-hand hearing aid 11 analogously has a decision-making unit 19 for deciding whether the sending mode of right-hand hearing aid 11 is or is not to be assumed. The input signal of decision-making unit 19 is a right-hand signal rs which here, too, constitutes an internal input signal of right-hand hearing aid 11 and can be, for example, a microphone signal. The right-hand hearing aid 11 moreover here, too, has a decision-making unit 20 for deciding whether the sending mode of right-hand hearing aid 11 will or will not be deactivated.

The sending mode of right-hand hearing aid 11 can be activated by output signal atr of decision-making unit 19. The signal atr therefore serves as an actuating signal for a switch 21. If the switch 21 is in the switched-on condition as in the example shown in FIG. 2, then right-hand signal rs will be transmitted as the communication signal to left-hand hearing aid 10 over (virtual) line 14.

Not only the left-hand signal Is but, because of the activated binaural data transmission, also the right-hand signal rs is available to the decision-making unit 17 for deactivating the sending mode of left-hand hearing aid 10. The decision-making unit 17 analyzes the two signals and supplies an appropriate deactivation signal dtl of left-hand hearing aid 10. The switch 18 can be driven by the deactivation signal dtl. If the sending mode is to be deactivated, the switch 18 will be appropriately switched over so that a data link will no longer exist over (virtual) line 15. The left-hand signal Is will then cease being transmitted to right-hand hearing aid 11.

The decision-making unit 20 of right-hand hearing aid 11 will analogously thereto be fed with the two internal input signals rs and Is if communication link 13 still exists in keeping with the example shown in FIG. 2. The decision-making unit 20 will generate a deactivation signal dtr of the right-hand hearing aid 11 in dependence on the two signals rs and Is. The switch 21 of the right-hand hearing aid 11 is also driven by the deactivation signal dtr. The switch 21 will accordingly be opened after a deactivation decision so that right-hand signal rs will no longer be transmitted to left-hand hearing aid 10 over (virtual) line 14.

The hearing aids' decisions about activating and deactivating communication link 13 are initially mutually independent. That also means, for example, that a sending mode from the left-hand hearing aid 10 to the right-hand hearing aid 11 can have been activated while a sending mode from the right-hand hearing aid 11 to the left-hand hearing aid 10 has been deactivated (or vice versa). The hearing aids 10, 11 can of course both be in sending mode, or the sending mode has been deactivated in both hearing aids.

However, in a specific embodiment variant the decisions of hearing aids 10, 11 are synchronized. That is symbolized in FIG. 2 by double arrow 22. The two hearing aids 10, 11 are therein synchronized by a synchronizing signal syn. The synchronizing signal is also transmitted over communication link 13, for example.

The acoustic environment is continuously analyzed on a monaural basis while the binaural system is operating. That means that analyzing takes place in parallel in the left-hand hearing aid 10 and the right-hand hearing aid 11. Each side can decide based on predefined criteria whether it would be useful to employ a binaural link or, as the case may be, communication 13 (for example over one or two lines 14, 15). The two hearing aids 10, 11 will then be mutually linked if applicable. A low-rate data link is preferably used for linking them.

The synchronizing decision made by one hearing aid is favorably conveyed to the other hearing aid. Both sides can thereby come to a joint decision, with specified rules being followed. Once established, the link will be maintained or deactivated on the basis of other criteria. For deactivating, additional information will as described above be provided by the audio signal from the other side.

Presented below are some exemplary criteria according to which the decision-making units 16, 17, 19, and 20 are able to decide about activating and deactivating the respective sending mode. The decision-making units can as one instance use the background noise as a criterion. In the case of monaural evaluating before the communication link is established, a check can be performed to determine whether the continuous noise level of the background noises exceeds a predefined level for a certain period of time in the monaural, directional microphone signal. That is an indication of a difficult hearing situation in which it is possible to benefit from binaural, directional processing. Thus in a situation of such kind a binaural directional microphone will be activated (to narrow the focus in the frontal direction, for example) if the measured basic noise exceeds a certain level on one side. An activation instruction for the binaural audio link is for that purpose sent to the other side, which is to say to the other hearing aid.

When the binaural link has been set up, additional information sources will be available that also allow other criteria to be checked for deciding whether binaural processing is to be maintained or deactivated. It will thus be possible, for example, to calculate a signal in keeping with what is termed the "binaural eight". The signal corresponds to phase-correct subtracting of two monaural beam-shaper signals or two omnidirectional signals. The signal consists substantially of sound components from the sideways directions, with signals from the front being eliminated. The binaural eight explicitly excludes signals arriving from the front (zero-grade direction). That is the main difference compared with the monaural case. Since what narrow focusing achieves is that precisely those signals from frontal sideways directions (ranges of around +45° and −45°, for example) will be eliminated, more accurate and reliable activation controlling will be possible with the aid of the level of the thus obtained signal's basic noise because the zero-grade useful signal will not be contained.

The probability of a speech signal can be used as another criterion for the decision-making units. The probability of speech being present in the current signals is for that purpose calculated separately on both sides. Based thereupon, a directed beam to the side (what is termed "sideways glancing") will be activated if the probability of a speech signal's arriving from the side is greater than, for example, the probability of speech arriving from the front, from behind, or from the opposite side. That decision is, though, reached without emitting a directional beam on both sides. The beams to the left-hand and the right-hand side or, as the case may be, the omnidirectional signals from the left-hand and right-hand side will be available once a binaural audio-data link has then be established. Hence the decision to maintain or deactivate "sideways glancing" (beam to the left-hand or right-hand side) can be based on the probability that speech is present in the directional signal. That is significantly more reliable than basing the decision only on the two monaural signals from the left-hand and right-hand hearing aid.

Information can furthermore also be obtained about the extent to which it is possible to benefit from beam shaping with the aid of the probability of a speech signal in the monaural signals or binaural directional signals. If, for example, the probability of a speech signal in an omnidirectional signal is high and the probability of a speech signal on the other side of the head in the other omnidirectional signal is likewise high, then little benefit will be obtained from binaural processing because there are very many sound interferences. The aim will furthermore be to avoid beam shaping also in a quiet environment in order to retain the impression of omnidirectional sound and to save battery power.

The intensity of the targeted effect can serve as another criterion for deciding whether a binaural audio link should or should not be set up. The effectiveness criterion can be used for different applications of the binaural audio link such as, for instance, for wind-noise suppression or feedback suppression. If, for example, the link was activated on the basis of a monaural criterion indicating "wind" or "feedback" and the binaural algorithm starts operating, then its effectiveness can be calculated. It can be determined from how noticeable the relevant reduction in wind noise or feedback is in the output signal compared with the input signal. The binaural data link can then be maintained or deactivated based on the value that is determined.

A binaural audio link based on monaural decisions is thus inventively possible. The binaural audio link can moreover be maintained or deactivated on the basis of additional binaural decisions. In parallel therewith it is possible also for binaural algorithms to be activated and deactivated automatically. Those are, for example, a narrow directed lobe (a binaural directional microphone having a narrow lobe (+/−20°) in a frontal direction), "sideways glancing" (binaural lobe directed to the left-hand or right-hand side), binaural wind-noise suppression, and/or binaural feedback suppression. The automatic activation and deactivation of the binaural algorithms and of binaural communication allows energy to be saved and battery life to be prolonged.

The invention claimed is:

1. A method for operating a hearing system having binaural hearing devices including a left-hand hearing device and a right-hand hearing device, which comprises the steps of:

providing a left-hand internal input signal in the left-hand hearing device;

providing a right-hand internal input signal in the right-hand hearing device;

activating a sending mode of at least one of the hearing devices, the sending mode being activated in one of the hearing devices automatically in dependence on at least one of the left or right internal input signal, wherein, it is calculated with what probability a speech sound, referred to a specified frontal direction, is coming from a side or from a front or behind, with the sending mode being activated if the probability of the speech sound coming from a side is greater than a probability of the speech sound coming from the front or behind;

deactivating the sending mode, the sending mode being deactivated in one of the hearing devices in dependence on at least one of the left or right internal input signal and of a communication signal received from the respective other hearing device; and wherein a decision reached by one of the hearing devices on a monaural basis regarding activating the sending mode is made known to the respective other one of the hearing devices operating on a monaural basis so that the other hearing device will activate the sending mode in dependence on the decision received, wherein the decision received for activating the sending mode of the other hearing device has a higher priority than the internal input signal of the respective hearing device.

2. The method according to claim 1, wherein, for activating the sending mode, the internal input signal is analyzed by the respective hearing device in terms of a background noise and the sending mode will be activated if a level of the background noise continuously exceeds a specified threshold.

3. The method according to claim 1, wherein, for deactivating the sending mode, components of a binaural directional-microphone signal are used but not signal components around a specified frontal direction.

4. The method according to claim 1, wherein the sending mode is not activated or is deactivated if the internal input signals of both of the hearing devices are below a specified level.

5. The method according to claim 1, which further comprises activating a binaural process, namely a binaural directional microphone, a binaural wind-noise suppression, or a binaural feedback suppression, when the sending mode is activated.

6. The method according to claim 5, which further comprises deactivating the sending mode if an effectiveness of binaural processing is below a specified level.

7. A binaural hearing system, comprising:

a left-hand hearing device for receiving a left-hand internal input signal;

a right-hand hearing device for receiving a right-hand internal input signal;

the binaural hearing system programmed to:

activate a sending mode of at least one of said left-hand hearing device or said right-hand hearing device, the sending mode can be activated in one of said right-hand hearing device or said left-hand hearing device automatically in dependence on the respective internal input signal, wherein it is calculated with what probability a speech sound, referred to a specified frontal direction, is coming from a side or from a front or behind, with the sending mode being activated if the probability of the speech sound coming from a side is greater than a probability of the speech sound coming from the front or behind; and deactivate the sending mode, the sending mode can be deactivated in one of said left-hand hearing device or said right-hand hearing device automatically in dependence on the respective internal input signal and of a communication signal received from the respective other said hearing device; and wherein a decision reached by one of the hearing devices on a monaural basis regarding activating the sending mode is made known to the respective other one of the hearing devices operating on a monaural basis so that the other hearing device will activate the sending mode in dependence on the decision received, wherein the decision received for activating the sending mode of the other hearing device has a higher priority than the internal input signal of the respective hearing device.

* * * * *